US006913088B2

(12) United States Patent
Berger

(10) Patent No.: US 6,913,088 B2
(45) Date of Patent: Jul. 5, 2005

(54) HAMMER DRILL AND /OR PERCUSSION HAMMER WITH NO-LOAD OPERATION CONTROL THAT DEPENDS ON APPLICATION PRESSURE

(75) Inventor: Rudolf Berger, Grünwald (DE)

(73) Assignee: Wacker Construction Equipment AG, Munich (DE)

( * ) Notice: Subject to any disclaimer, the term of this patent is extended or adjusted under 35 U.S.C. 154(b) by 0 days.

(21) Appl. No.: 10/485,673

(22) PCT Filed: Sep. 12, 2002

(86) PCT No.: PCT/EP02/10253

§ 371 (c)(1),
(2), (4) Date: Jan. 30, 2004

(87) PCT Pub. No.: WO03/024672

PCT Pub. Date: Mar. 27, 2003

(65) Prior Publication Data

US 2004/0177981 A1 Sep. 16, 2004

(30) Foreign Application Priority Data

Sep. 14, 2001 (DE) ..... 101 45 464

(51) Int. Cl.[7] ..... E02D 7/02
(52) U.S. Cl. ..... 173/48; 173/201
(58) Field of Search ..... 173/48, 201

(56) References Cited

U.S. PATENT DOCUMENTS 4,074,777 A * 2/1978 Andersson et al. ..... 173/138
4,222,443 A * 9/1980 Chromy ..... 173/201
4,305,473 A * 12/1981 Gidlund ..... 173/16
4,388,972 A * 6/1983 Gidlund ..... 173/162.1
4,483,402 A * 11/1984 Vonhoff, Jr. ..... 173/207
5,161,623 A * 11/1992 Erlach ..... 173/14
5,533,579 A * 7/1996 Chu ..... 173/17
6,076,616 A * 6/2000 Kramp et al. ..... 173/162.2
6,209,659 B1 * 4/2001 Blessing ..... 173/201
6,237,700 B1 * 5/2001 Berger et al. ..... 173/201
6,691,798 B1 * 2/2004 Lindsay ..... 173/115
2002/0003045 A1 * 1/2002 Bongers-Ambrosius

FOREIGN PATENT DOCUMENTS

| | | | |
|---|---|---|---|
| DE | 323766 | 8/1920 | |
| DE | 197 13 154 A1 | 10/1997 | |
| DE | 197 14 288 A1 | 10/1998 | |
| DE | 197 24 531 A1 | 12/1998 | |
| DE | 198 47 687 A1 | 4/2000 | |
| GB | 242218 | 3/1926 | |
| WO | WO 16948 A1 * | 3/2000 | ..... B25D/11/00 |
| WO | WO 2072315 A1 * | 9/2002 | ..... B25D/11/00 |

* cited by examiner

*Primary Examiner*—Scott A. Smith
*Assistant Examiner*—Brian Nash
(74) *Attorney, Agent, or Firm*—Boyle Fredrickson Newholm Stein & Gratz S.C.

(57) ABSTRACT

A percussion hammer drill and/or percussion hammer that can be guided by a handgrip comprises a pneumatic spring striking mechanism with a reciprocating drive piston and with a percussion piston that can be operated by the drive piston. A cavity for accommodating a pneumatic spring is provided between the drive piston and the percussion piston. The cavity can be connected to the surrounding area via a no-load operation channel in order to achieve a no-load operation. This this end, a valve is situated inside the no-load operation channel and can be controlled according to an application force that can be applied to the handgrip by the operator.

19 Claims, 8 Drawing Sheets

HAMMER DRILL AND /OR PERCUSSION HAMMER WITH NO-LOAD OPERATION CONTROL THAT DEPENDS ON APPLICATION PRESSURE

BACKGROUND OF THE INVENTION

1. Field of the Invention

The present invention relates to a hammer drill and/or percussion hammer according to the preamble of patent claim 1.

2. Description of the Related Art

A hammer drill and/or percussion hammer, designated "hammer" in the following, standardly has an air pneumatic spring hammer mechanism in which a drive plunger is set into an oscillating back-and-forth movement by an electric motor, using a crankshaft or wobble shaft drive. A percussion piston is situated before the drive piston, so that a hollow space, in which an air spring can form, is present between the drive piston and the percussion piston. The air spring transmits the back and forth movement of the drive piston to the percussion piston, and drives this percussion piston against the shaft of a tool or against an intermediately connected rivet header. Hammers of this sort are known in many different specific embodiments.

In the use of the hammer for work at a particular location, the operator must place the tip of the tool, for example the chisel tip, very carefully in order to prevent the chisel tip from jumping away. This is true in particular for relatively smooth or raised points on the material to be worked. However, because air spring hammer mechanisms having a simple design have a tendency to begin percussion operation suddenly, the undesired jumping away cannot always be avoided. This can have the result that the stone is chiseled at a point that is not supposed to be damaged. In the processing of edges, there is even the danger of damage to the hammer or to the operator himself, if the chisel jumps into the air from the edge.

In order to remove this problem, various solutions have been proposed. Thus, it is known to avoid, or at least to attenuate, an abrupt beginning of percussive operation by reducing the no-load motor speed. However, this has the disadvantage that the characteristic of the motor speed is always the same when accelerating from no-load operation to percussion operation, while the particular case of application requires a specifically adapted run-up. In addition, the lowering of the motor speed prevents the rapid creation of a stabilizing centering in the material that is to be worked.

A different solution is described for example in DE-A-197 13 154 or in DE-A-197 24 531, in the form of what is known as a sleeve controlling. Here, the effect is exploited that the tool is held so as to be capable of axial motion relative to the hammer, and can slide out of the hammer housing somewhat in the no-load setting. When the tool is placed on the stone that is to be worked, the shaft of the tool is pushed into the interior of the hammer, and effects (standardly by displacing the percussion piston relative to the drive piston) a transition from no-load operation to percussion operation.

In sleeve controlling, the relative movement of the tool to the hammer housing is transmitted to a spring-loaded control sleeve either directly or via an intermediate piston. The control sleeve works together with control bores, with which a no-load air channel can be opened and closed that connects the hollow space that accommodates the air spring, situated between the drive and percussion piston, with the surrounding environment. The displacement of the control sleeve thus makes it possible to bring the hollow space into communicating connection with the surroundings of the and are mechanism, or to close such a connection. Through this controlling of the ventilation of the air spring hollow space, the change between no-load operation and percussion operation can be realized very reliably.

Because in sleeve controlling the motor speed of the drive motor, and thus the number of impacts, remain almost unchanged, a centering in the material being processed, providing a place of purchase for the tool, can be produced very quickly, in contrast to the above-described reduction of motor speed. Through this high degree of controllability, the operator can optimally determine the strength of the individual impacts for each particular case of application.

However, sleeve controlling also has a disadvantage. As already explained, during the movement of the tool shaft into the interior of the hammer housing, the control sleeve is displaced against the action of a spring. Thus, the pressure to be applied by the operator is increased by the spring force between the tool shaft, or a rivet header connected thereto, and the hammer housing. Especially in heavy hammers, this is disadvantageous because the spring acting on the control sleeve must be designed such that it has to support at least the weight of the tool on the one hand, or the weight of the hammer on the other hand, in order to avoid an undesired change from no-load operation to percussion operation. If work is to be carried out with the hammer oriented upward, this means that even in no-load operation the entire weight of the tool lies against the control sleeve, and thus against the spring, so that the spring has to hold the tool. The change to percussion operation must take place only when the tool is pressed against the stone that is to be worked.

The same holds for work oriented downward. Here, in particular for heavy breaking hammers it must be possible to place the tool on the ground and to support the entire hammer on the tool, while remaining in no-load operation. Percussion operation should begin only when the hammer is pressed downward by the operator.

Given a change of position of the hammer, for example given operation in the horizontal direction, the support due to the weight of the tool or hammer, otherwise present, is in addition missing. The operator then must apply still greater forces.

OBJECTS AND SUMMARY OF THE INVENTION

The underlying object of the present invention is to indicate a hammer drill and/or percussion hammer in which, when the hammer is pressed against the stone to be worked, an appropriate circuit ensures a reliable change between no-load and percussion operation, without excessive increase in the pressure force that is to be applied by the operator.

The solution according to the present invention is indicated in patent claim 1. Advantageous further developments of the present invention are stated in the dependent claims. The hammer drill and/or percussion hammer according to the present invention (designated "hammer" in the following) that can be guided at a grasping point on a handle, has (as do known hammers also) a no-load channel for connecting a hollow space, formed between a drive piston and a percussion piston, with the surrounding environment. In the no-load channel, a valve is provided for opening and closing the no-load channel. According to the present invention, the hammer is characterized in that in the flow of force between the grasping point and the hammer housing there is situated an acquisition device for acquiring a pressure force that can be applied to the handle by the operator, and that the valve can be controlled dependent on the acquired pressure force.

The acquisition device is therefore situated at a point at which the pressure force applied by the operator can be acquired as immediately as possible. In this way, it is possible to acquire, in a much more direct fashion than is possible in the prior art, the operator's wish to place the hammer into percussion operation from no-load operation by applying the pressure force.

The acquisition device can be realized in various forms. Thus, in a specific embodiment of the present invention it is for example possible for the handle to be guided so as to be movable relative to the hammer housing, against the action of a spring system. In this case, a pressure force acting on the handle corresponds to a relative displacement between the handle and the hammer housing. On the other hand, the acquisition device can also be realized by a suitable sensor mechanism. In any case, the pressure force, acquired mechanically or mechatronically, is used as a criterion for controlling the valve via which the hollow space in the air spring hammer mechanism can be brought into connection with the surrounding environment.

Thus, for the controlling of the valve the relative path of the tool shaft or of the rivet header in relation to the hammer housing is not relevant for controlling no-load operation, as is the case in the prior art. Rather, the pressure force applied by the operator, or the relative path of the handle in relation to the hammer housing surrounding the air spring hammer mechanism resulting therefrom, becomes the decisive factor. In this way, it is ensured that the pressure force or control force required for the controlling of no-load and percussion operation does not enter into the pressure force that is to be applied by the operator, and thus does not increase this force, as is the case in the prior art. The pressure force applied by the operator is evaluated directly, and this force need not be increased in order to overcome stronger spring forces.

While in the prior art a force present in the flow of force between the operator and the tip of the tool on the tool shaft, or on the rivet header, was evaluated for the controlling of the valve (in the prior art: the control sleeve), according to the present invention the pressure force applied by the operator and introduced at the handle is the decisive criterion.

In an advantageous construction of the present invention, a spring system is present between the handle and the hammer housing, in order to hold the handle relative to the hammer housing with a predetermined spring force. The pressure force can be determined by acquiring a displacement of the handle, proportional to the pressure force, relative to the hammer housing.

In a particularly advantageous specific embodiment of the present invention, the spring system is a component of an apparatus for damping the vibrations of the handle. This is because, in larger hammers in particular, designs are known in which the handle that is to be grasped by the operator is decoupled in terms of vibration from the rest of the hammer housing, in order to achieve a certain degree of dampening and to relieve stress on the operator. In these handle designs, the required relative movability between the handle and the hammer housing is already realized, so that only the relative displacement proportional to the pressure force need be acquired.

In a particularly advantageous specific embodiment of the present invention, an axially movable sleeve is provided that corresponds in principle to the control sleeve known from the prior art, and that forms a control element of the valve. However, according to the present invention the axial position of the sleeve can be modified dependent on the pressure force applied by the operator. In contrast, in the prior art the control sleeve can be moved only by the relative displacement between the tool and the hammer housing, which, as described above, led to a significant increase in the pressure force to be applied by the operator, due to the differently acting weight forces and correspondingly dimensioned springs for the support of the control sleeve.

In a further development of the present invention, the sleeve is connected in positively locking fashion with the handle in the axial direction, so that the relative movement of the handle (proportional to the pressure force applied by the operator) in relation to the hammer housing can be transmitted directly as a relative displacement of the sleeve in relation to the housing.

The solution described is suitable in principle for all known types of air spring hammer mechanisms. These include for example tube hammer mechanisms, in which the drive piston and the percussion piston, having the same diameter, are situated in a tube so as to be capable of axial movement. Likewise, a hollow-impact hammer mechanism is known in which the percussion piston has a hollow construction and accommodates the drive piston in its interior in axially movable fashion.

However, a particularly advantageous specific embodiment of the present invention relates to a hollow-piston hammer mechanism in which the drive piston has a hollow construction and accommodates the percussion piston in its interior in axially movable fashion. The drive piston is surrounded radially by the sleeve, which in turn is contained in a hammer mechanism housing. Openings or recesses, together forming the no-load channel, are provided in the drive piston, in the sleeve, and in the hammer mechanism housing. The sleeve acts as a control element of the valve, and is able, dependent on its axial position, to open or to close the connection between the hollow space in the interior of the drive piston and the surrounding environment of the air spring percussion mechanism.

Besides the above-explained mechanical realization of the present invention, it is also possible to realize the technical teaching that forms the basis of the present invention in mechanical-electrical or mechatronic fashion.

Thus, in another advantageous specific embodiment of the present invention, the acquisition device has a sensor with which the pressure force acting on the handle can be acquired, in particular through the action of the handle via the spring system against the hammer housing. The sensor supplies a pressure signal to a control unit, which correspondingly controls the valve element for opening and closing the valve.

Here, it is particularly advantageous if the sensor is a proximity sensor or a force measurement sensor, in order to enable the acting pressure force to be acquired reliably.

Moreover, in a further construction of the present invention a position sensor is provided with which the position of the hammer in space can be acquired and a corresponding position signal can be produced. The position signal is supplied to the control unit, which thereupon subjects the pressure signal to a corrective procedure, in order for example to exclude undesired weight forces. If the operator is working for example with the hammer oriented downward, he need not hold the hammer in his hand, but rather can support it on the ground. Conversely, if the hammer is oriented upwards the operator must support the weight of the hammer completely at the handle. This weight influence can be eliminated by the position sensor.

The central idea of the present invention is to enable a soft attack for the hammer, i.e., an initiation of percussion operation when the tool is pressed only lightly against the stone to be processed. Correspondingly, at this time the impact force acting on the tool should still be very low, and should be increased only when the pressure is stronger. In this way, the tool can be positioned precisely even when the drive motor is at full rotational speed, without jumping away from the stone to be processed.

This and additional advantages and features of the present invention are explained in more detail below on the basis of a plurality of examples, with the aid of the accompanying Figures.

DETAILED DESCRIPTION OF THE PREFERRED EMBODIMENTS

Figure 1A:
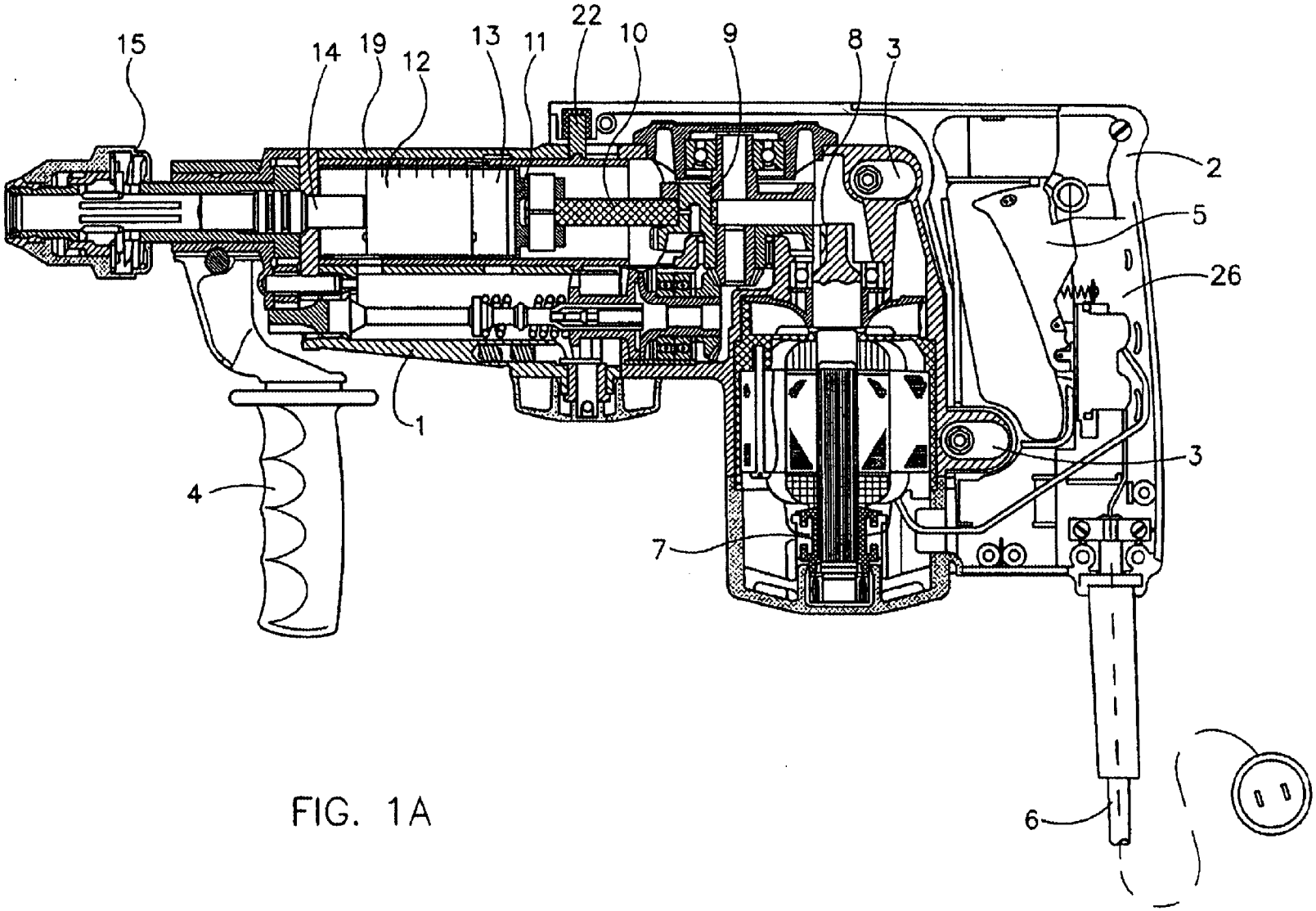
FIG. 1A shows a sectional view of a hammer drill and/or percussion hammer (hammer) according to a first specific embodiment, in percussion operation.

FIGS. 1A to 3B show the hammer according to a first specific embodiment in different operating states and different detail enlargements. The hammer according to the second specific embodiment is shown in FIGS. 4 to 5B. First, the hammer according to the first specific embodiment is described on the basis of FIGS. 1A and 1B.

On a hammer housing 1, a handle 2 is attached so as to be capable of axial displacement via spring systems 3. On the front end of hammer housing 1, an additional handle 4 is fastened, which however is not important for the present invention and serves only for the improved guiding of the hammer.

Spring system 3 can be for example an anti-vibration system for mitigating the vibrations and impacts—acting on handle 2 and produced by the air spring hammer mechanism or by the action of the tool—on handle 2, and thus on the operator's hand, which grasps handle 2 at a grasping point 2*b*. To the extent that such an anti-vibration system is already provided in a known hammer, no design modifications would need to be carried out at this location. However, it is also possible to install only one spring system, permitting a displacement of handle 2 in relation to handle 1, on the basis of which the pressure force acting on handle 2 can be determined via a relationship of proportionality.

In the interior of handle 2, among other things there is provided a main switch 5 for switching the hammer on and off. Moreover, a line cable 6 is connected to handle 2. In the interior of hammer housing 1 there is situated an electric motor 7 that drives a crankshaft 9 via a gear mechanism 8. Via a connecting rod 10, crankshaft 9 produces a back-and-forth movement of a hollow drive piston 11. In the interior of sleeve-shaped drive piston 11, which is capable of back-and-forth movement, a percussion piston 12 is accommodated so as to be capable of axial movement. Between drive piston 11 and percussion piston 12 there is provided a hollow space 13 in which, when there is relative movement between drive piston 11 and percussion piston 12, an air spring forms in a known manner, which drives percussion piston 12 against a rivet header 14 and suctions this piston back again after the impact has taken place, so that a new impact by percussion piston 12 can take place upon the next forward movement of drive piston 11. Rivet header 14 comes into contact with a shaft, accommodated in a tool holder 15, of a tool (not shown).

Because the basic design of such an air spring hammer mechanism has long been known, a detailed representation is not required.

Before percussion piston 12, there is provided a front hollow space 16 that, in percussion operation, stands in communicating connection with the surrounding environment of the air spring hammer mechanism, i.e. for example the rest of the interior of hammer housing 1, via an air channel 18 provided in a wall 17 of drive piston 11. In this way, the formation of an air cushion before percussion piston 12 in front hollow space 16, which could hinder the percussion effect of percussion piston 12, is avoided.

Drive piston 11, in particular its wall 17, is surrounded by a control sleeve 19. Control sleeve 19 can be moved axially in a hammer mechanism housing 20 that forms a part of hammer housing 1. In the example shown, on control sleeve 19 a collar 21 is provided that is surrounded by a dog 22. As can be seen clearly in FIGS. 1A and 1B, dog 22 is connected directly with an extension 2*a* of handle 2, so that a positively locking coupling that is effective at least in the axial direction of control sleeve 19 is realized between handle 2 and control sleeve 19. Because handle 2 can be moved relative to hammer housing 1 on the basis of the action of spring system 3, its movement is transmitted directly to control sleeve 19 via dog 22 and collar 21, and displaces control sleeve 19 axially in the interior of hammer mechanism housing 20.

Control sleeve 19 has a radial opening 23 that penetrates its wall. The position of radial opening 23 is selected such that in each operating state it corresponds with at least one opening 24 in wall 17 of drive piston 11, a plurality of openings 24 being formed in wall 17 in the axial direction of drive piston 11 (as is shown clearly in FIG. 1B in particular). According to the axial position of drive piston 11 or of control sleeve 19, at least one, possibly also two, openings 24 are situated at the level of radial opening 23.

On the inside of hammer mechanism housing 20, which cylindrically surrounds control sleeve 19, an opening 25 is formed, e.g. in the form of an annular channel surrounding control sleeve 19, said channel opening on its underside towards the interior of hammer housing 1, i.e., to the surrounding environment of the air spring hammer mechanism.

Openings 24 in drive piston 11, radial opening 23 in control sleeve 19, and recess 25 together form a no-load channel through which, in no-load operation of the air spring hammer mechanism, there can be created a communicating connection of hollow space 13 to the surrounding environment of the air spring hammer mechanism.

Figure 1B:
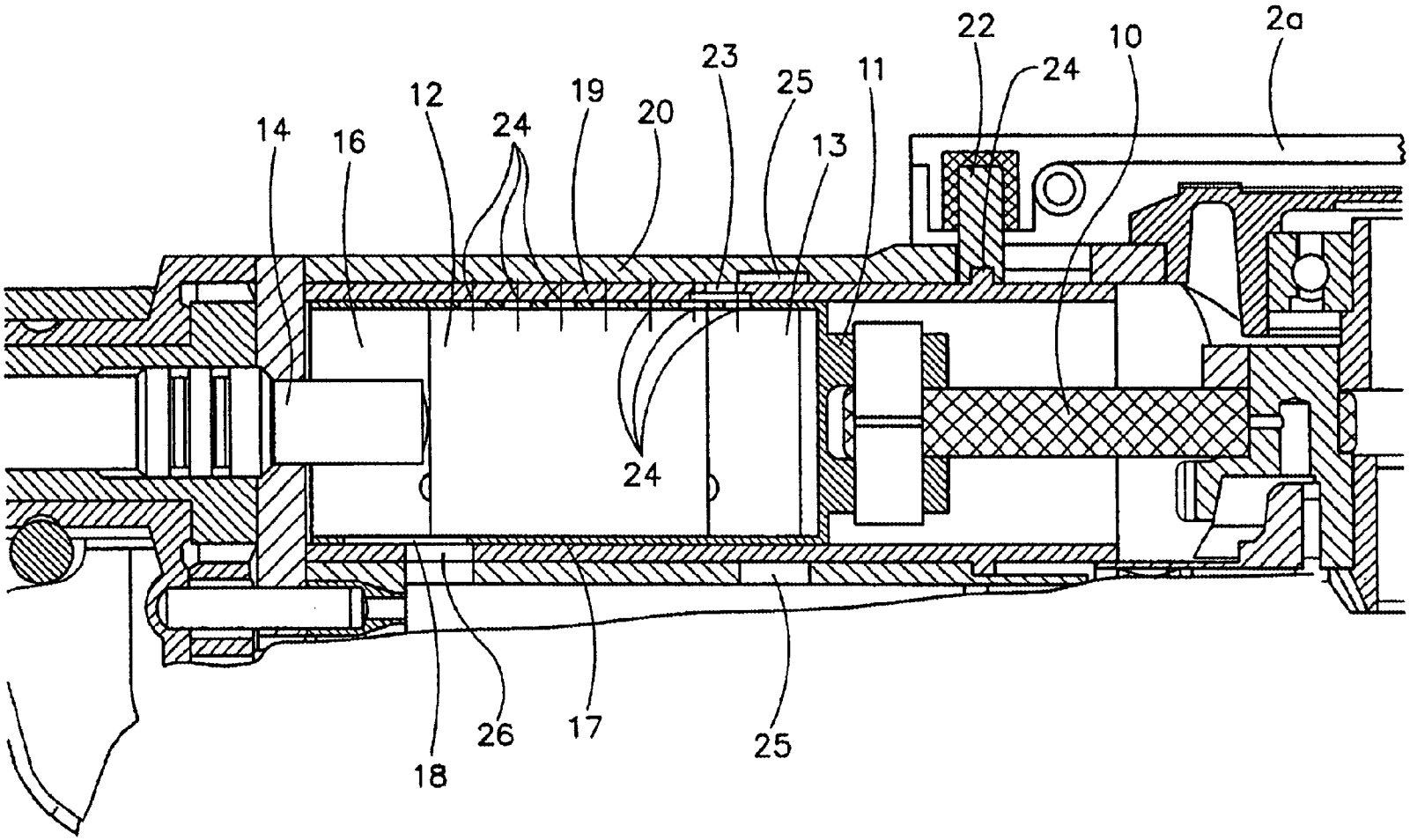
FIG. 1B shows an enlarged detail from FIG. 1A.

FIGS. 1A and 1B show the hammer, and in particular the air spring hammer mechanism, in percussion operation. Correspondingly, there should be no communicating connection between hollow space 13 and the surrounding environment. For this reason, control sleeve 19 is displaced in hammer mechanism housing 20 in such a way that radial opening 23 does not stand over recess 25. Thus, the connection is broken. Control sleeve 19, together with radial opening 23 accommodated by it, represents a valve for opening and closing the no-load channel.

The corresponding position of control sleeve 19 is effected in that the operator pushes handle 2 forward, against hammer housing 1 and against the action of spring system's 3. Correspondingly, he also presses the tool against the stone to be processed. The relative displacement of handle 2 in relation to hammer housing 1, which is proportional to the pressure force, is transmitted directly onto control sleeve 19, so that the desired axial position of control sleeve 19, shown in FIGS. 1A and 1B, results.

Advantageously, in the area of dog 22 a seal (not shown in the Figures) is provided that prevents dirt from penetrating into the interior of the hammer housing.

Figure 2:
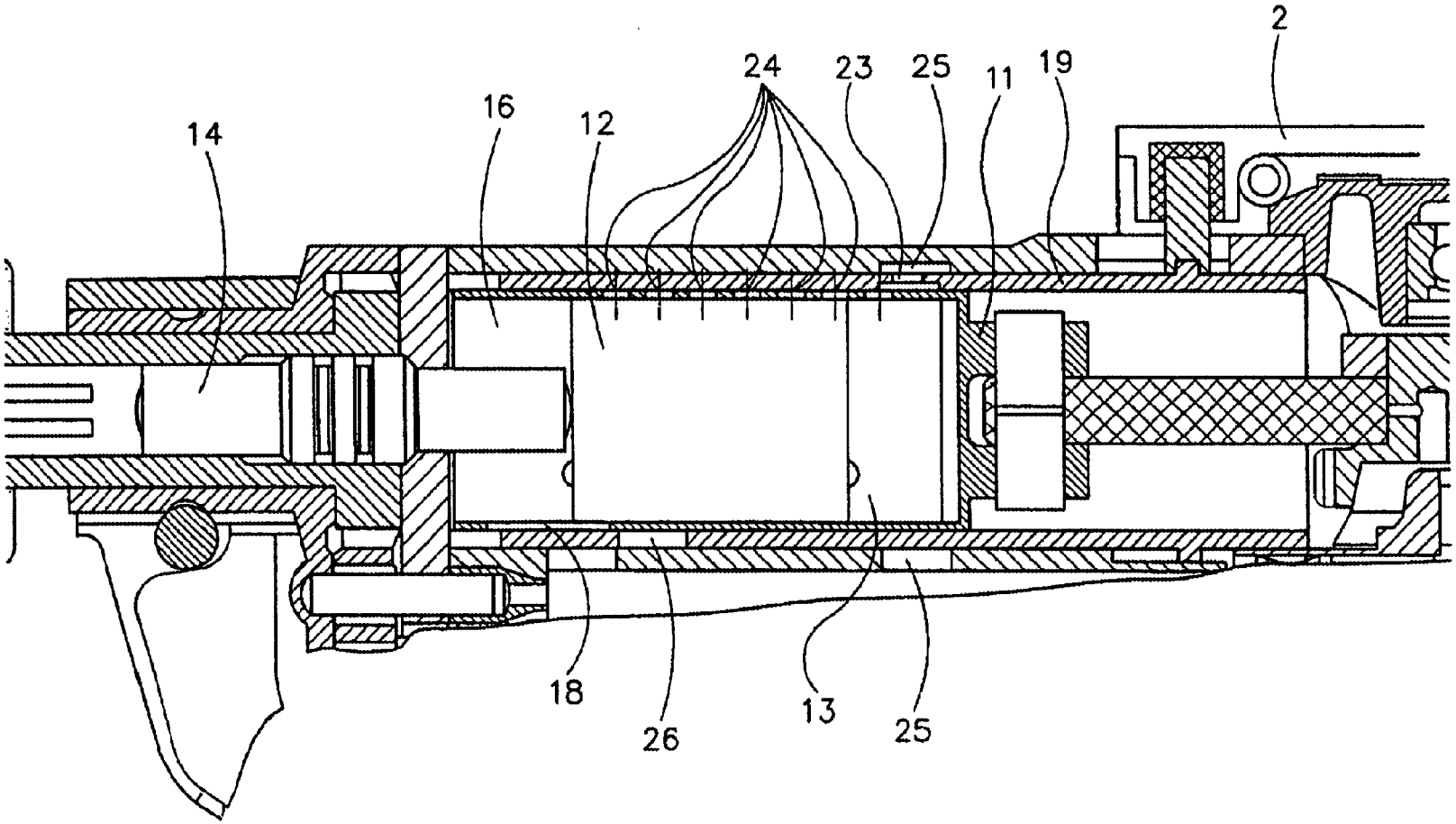
FIG. 2 shows an enlarged detail of the first specific embodiment according to FIG. 1A, but in no-load operation with the tool seated on the stone.

FIG. 2 shows an enlarged detail of the hammer from FIG. 1A, here however in no-load operation, in which the tool rests on the stone to be processed without pressure from the operator.

Due to the placement of the tool on the stone, rivet header 14 is in its rear position, displaced into the interior of hammer housing 1.

Due to the fact that the operator is not applying any pressure force, spring system 3 presses handle 2 towards the rear relative to hammer housing 1, so that handle 2 is displaced towards the rear together with control sleeve 19. As a result, radial opening 23 moves over opening 25, so that a communicating connection from hollow space 13 to the surrounding environment of the air spring hammer mechanism is created via the openings 24 of drive piston 11, which are always situated at the level of radial opening 23. Correspondingly, no excess air pressure or partial vacuum can build up in hollow space 13, and no air spring resulting therefrom can form. Rather, despite further back-and-forth movement of drive piston 11, an effective ventilation of hollow space 13 permanently takes place, so that percussion piston 12 remains in its position.

Due to the displacement of control sleeve 19, in addition a second radial opening 26 formed therein has been displaced axially in such a way that air channel 18, which connects front hollow space 16 to the surrounding environment, is interrupted. Correspondingly, front hollow space 16 is decoupled from the surrounding environment, so that a supply of air that remains in its interior forms an air cushion that counteracts a further impact by percussion piston 12.

If the operator wishes to initiate percussion operation, he will press slowly against handle 2, thus displacing control sleeve 19 against the action of spring system 3, until the no-load channel is interrupted by the displacement of radial opening 23. In this way, an air spring gradually forms in the interior of hollow space 13, which at first produces only light impacts of percussion piston 12 against rivet header 14. The full effect of the air spring hammer mechanism can take place only upon the complete separation of radial opening 23 from opening 25. Through suitable shaping of radial opening 23, for example in the form of an elongated hole, the change between no-load operation and percussion operation can be constructively influenced.

Figure 3A:
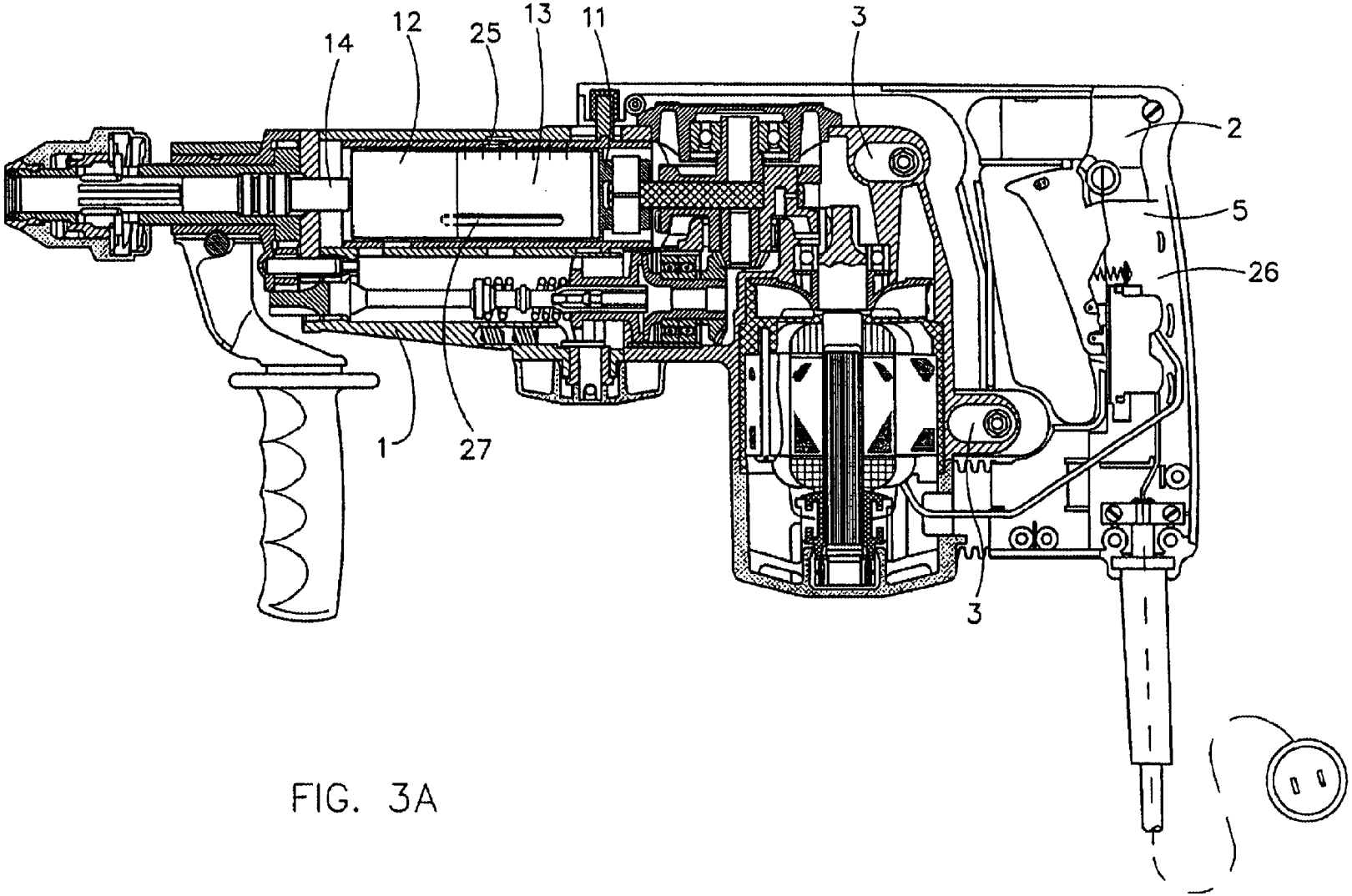
FIG. 3A shows a sectional view of the hammer according to the first specific embodiment in no-load operation, with the tool lifted off of the stone.
Figure 3B:
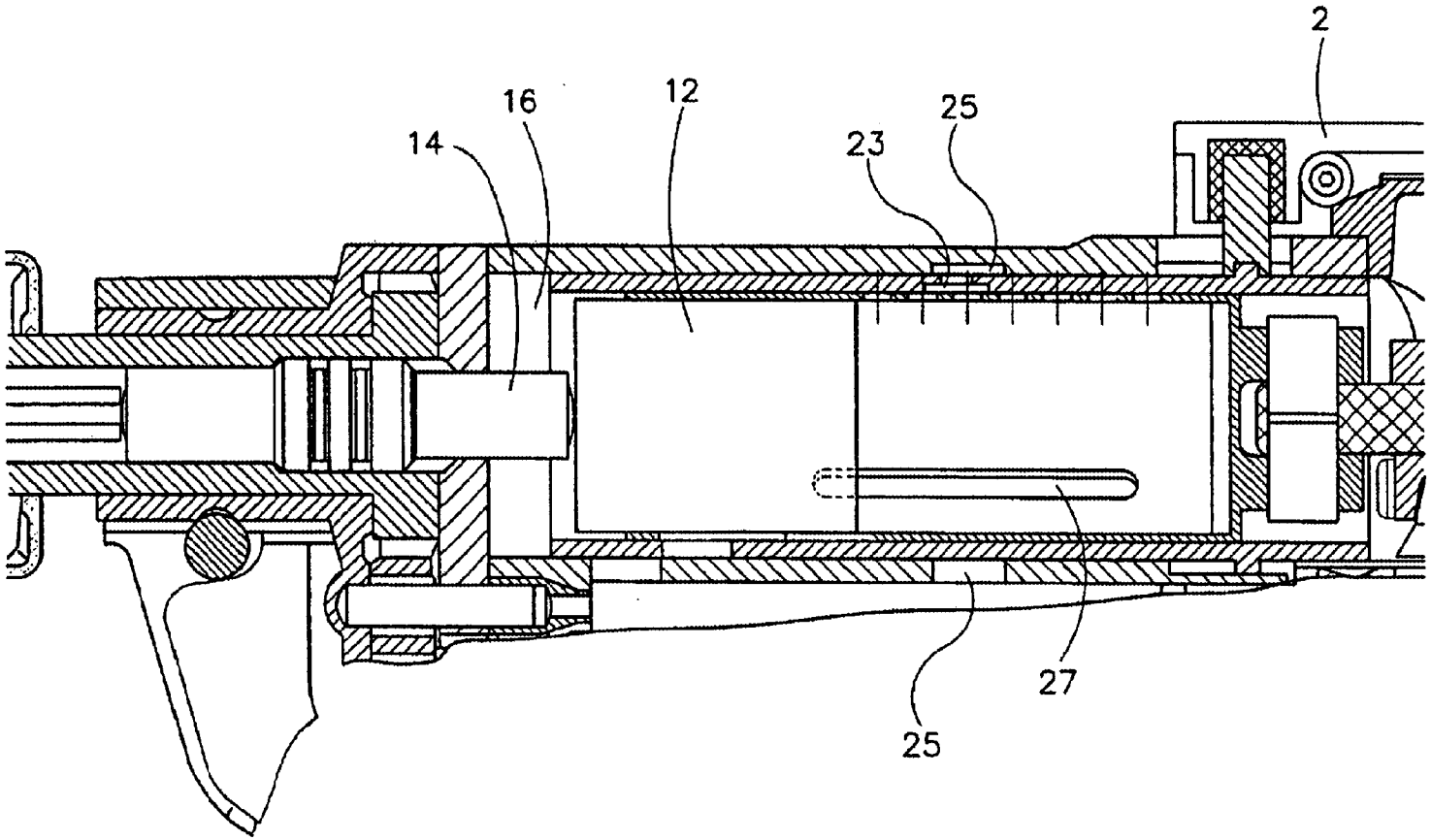
FIG. 3B shows an enlarged detail from FIG. 3A.
Figure 4:
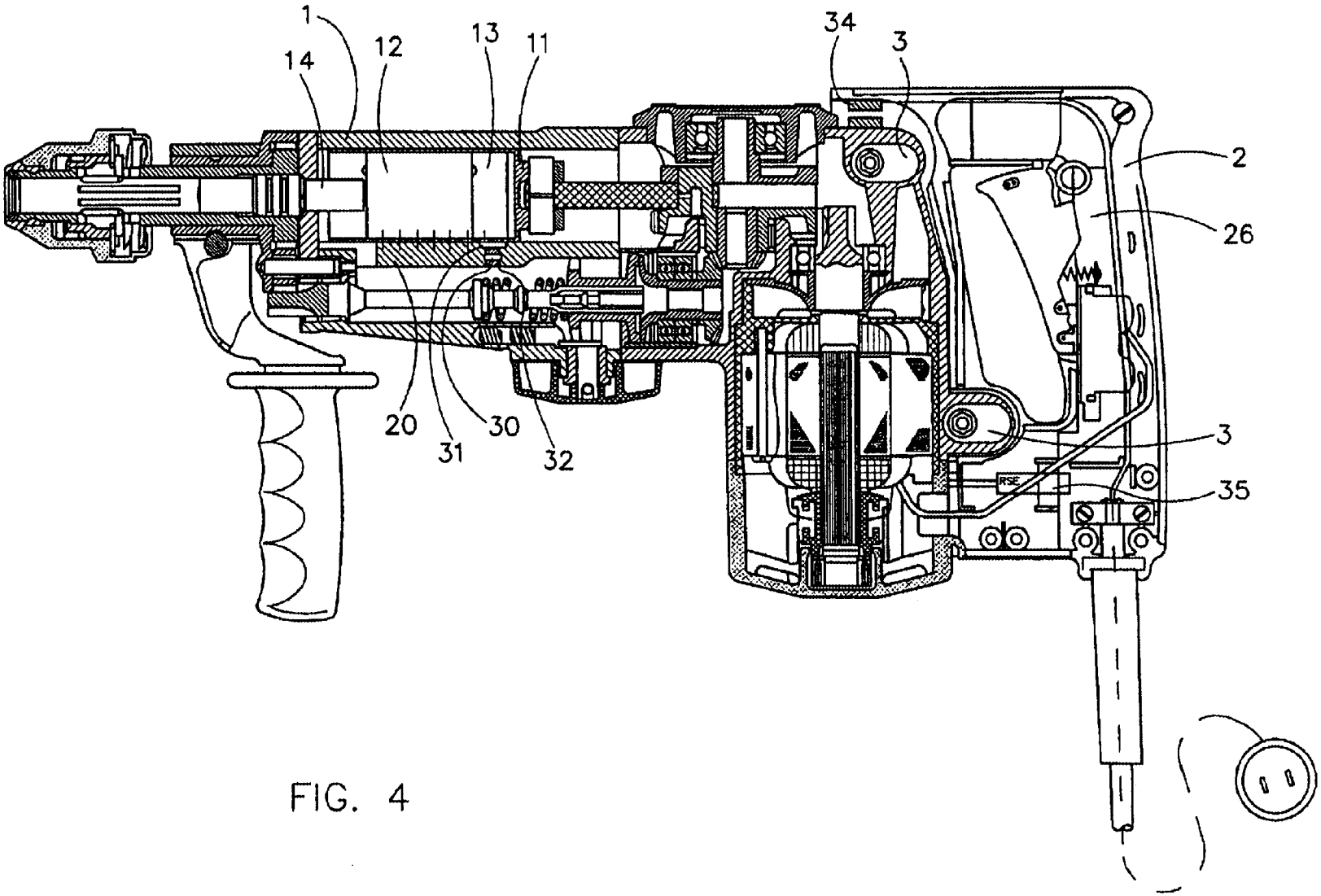
FIG. 4 shows a sectional view of a hammer according to the present invention in a second specific embodiment, in percussive operation.

Finally, FIGS. 3A and 3B show the hammer according to the present invention in no-load operation when the tool is lifted completely off the stone. Correspondingly, rivet header 14 is situated in its front position, because the tool has slid out of hammer housing 1.

The position of handle 2 and of control sleeve 19 in relation to hammer housing 1 is unchanged in relation to that shown in FIG. 2. Correspondingly, the no-load channel is opened over radial opening 23, so that hollow space 13 can be ventilated. In addition, in FIG. 3B a pocket 27, or recess, in wall 17 of drive piston 11 can be seen. Via pocket 27, the air spring in hollow space 13 can repeatedly be refilled with air during percussion operation, in order to compensate possible air losses between impacts. The basic principle of this is known, so that further discussion is not required.

Figure 5A:
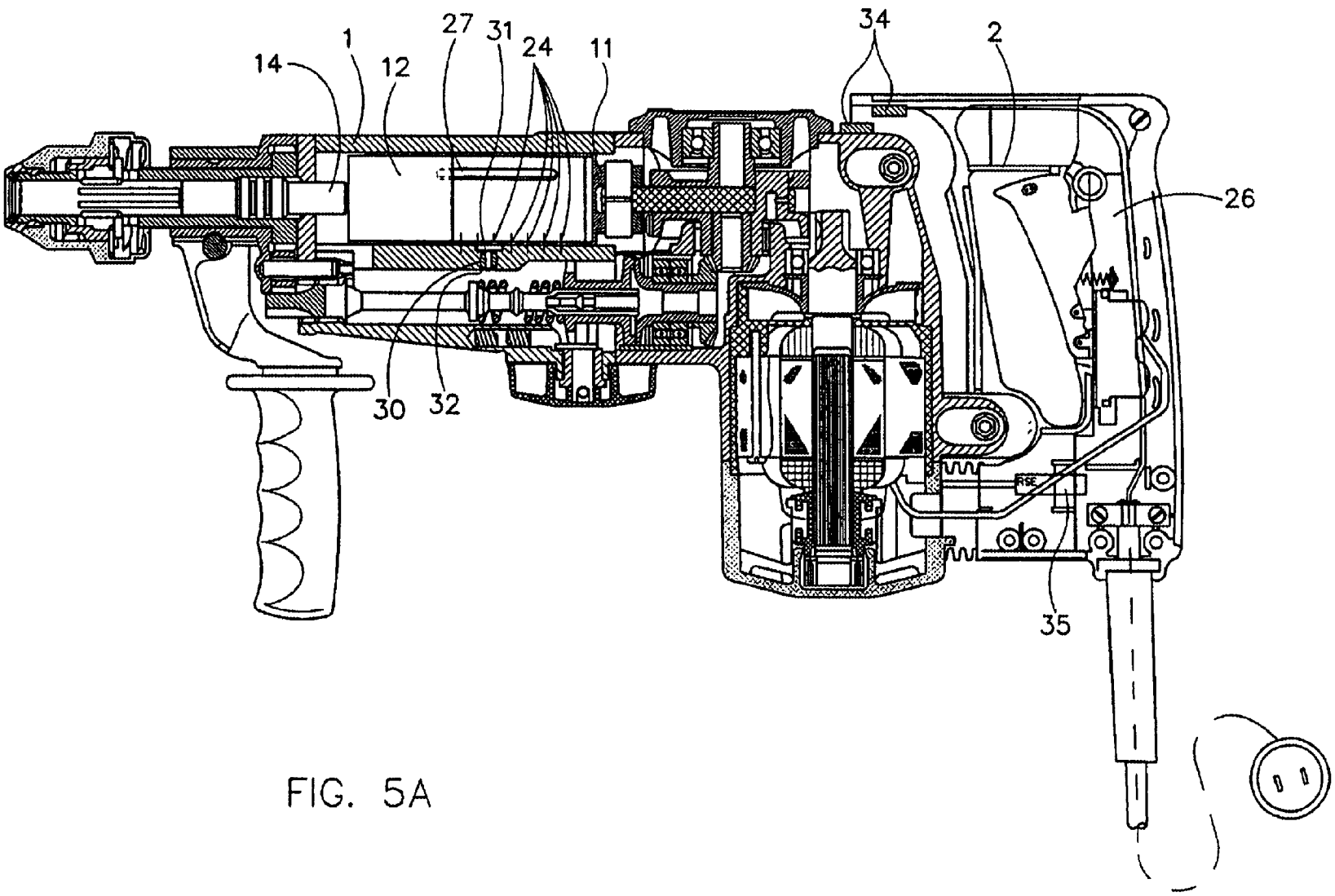
FIG. 5A shows the hammer of FIG. 4 in no-load operation.
Figure 5B:
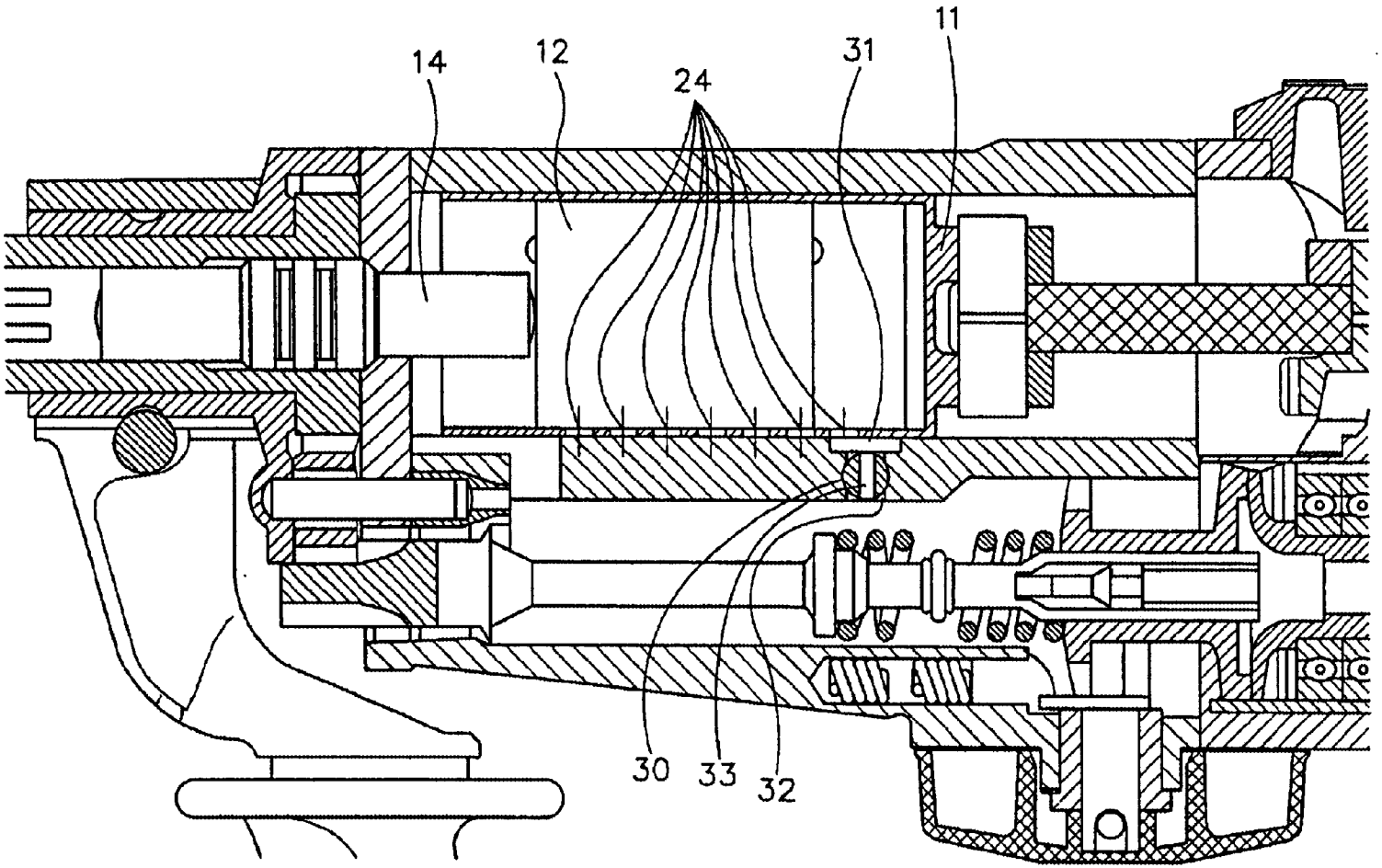
FIG. 5B shows an enlarged detail of FIG. 5A.

FIGS. 4, 5A, and 5B show the hammer according to the present invention in a second specific embodiment. While the above-described first specific embodiment enables a purely mechanical way of recognizing the pressure force applied to the handle by the operator, and a resulting influencing of the position of the valve that controls the connection of hollow space 13 with the surrounding environment, the second specific embodiment is based on a mechanical/electronic solution. Insofar as components are used that are identical to those in the first specific embodiment, the same reference characters are also provided. A repeated description of the corresponding elements is omitted.

Instead of control sleeve 19, a valve element 30 is placed in the no-load channel, which channel is very short in the second specific embodiment. Here, the no-load channel consists only of a recess 31 in percussion mechanism housing 20 and a connecting channel 32 in which valve element 30 is placed. Valve element 30 has a penetrating bored hole 33 in its interior. As can be seen in FIG. 4, as well as FIGS. 5A and 5B, valve element 30 is capable of rotation. For this purpose, an actuating element (not shown in the Figures) is provided.

While in FIG. 4 valve element 30 is rotated into a position in which bored hole 33 is not situated in the no-load channel, so that the connection between hollow space 13 and the surrounding environment of the air spring hammer mechanism is broken, in FIGS. 5A and 5B a position of valve element 30 can be seen in which bored hole 33 opens the no-load channel, and creates the connection between hollow space 13 and the surrounding environment.

In the second specific embodiment as well, handle 2 is attached so as to be capable of motion relative to hammer housing 1, against the action of spring system 3. The relative position between handle 2 and hammer housing 1 is acquired with the aid of a proximity sensor 34. Proximity sensor 34 can either be designed in such a way that it is capable of distinguishing only binary states, namely percussion operation/no-load operation, or, alternatively, with the aid of a suitable proximity sensor it is also possible to acquire the precise position of handle 2 relative to hammer housing 1 and to evaluate it correspondingly. Instead of proximity sensor 34, a suitable force measurement sensor can also be provided (for example in the interior of spring system 3, but also independent of spring systems), that acquires the pressure force applied by the operator. In addition, using a touch-sensitive force measurement sensor in handle 2 itself, it is possible to acquire the pressure force applied by the operator directly at grasping point 2*b*.

Proximity sensor 34 produces a pressure signal that corresponds to the pressure force (whether binary or proportional to the pressure force) and forwards it to a control unit 35. If control unit 35 recognizes that the operator is pressing the hammer so as to indicate that a transition from the no-load setting to the percussion setting is desired, control unit 35 controls the valve actuating element (not shown) in order to rotate valve element 30 into the position shown in FIG. 4. When the hammer is lifted, and the pressure force is correspondingly relieved, the reverse procedure is introduced.

In addition, in an additional specific embodiment, not shown in the Figures, a position sensor is provided that acquires the position of the hammer in space, in particular the angle of inclination of the tool axis, and emits a corresponding position signal to control unit 35. Control unit 35 evaluates the position signal in such a way that the weight forces, resulting from the position and thus the working orientation, of the tool and of the hammer (which, given a work position oriented upward, must be additionally supported by the operator at handle 2, or which in the case of downward orientation act on the tool and support the impact), can be taken into account in the evaluation of the pressure signal. In this way, the pressure forces, which otherwise vary greatly due to the effect of gravitation, can be compensated in accordance with the orientation of use.

Both the mechanical solution according to the first specific embodiment and also the mechatronic solution of the additionally described specific embodiments enable a particularly gradual running up of the hammer. The operator can carefully place the tip of the tool at the desired position, and by increasing the pressure force can effect a displacement of handle 2, and thus a gradual introduction of percussion operation.

What is claimed is:

1. A hammer drill and/or percussion hammer, comprising:

at least one handle having a grasping point for the holding of, and applying of pressure to, the hammer drill and/or percussion hammer by an operator;

an air spring hammer mechanism having a drive piston that moves back and forth and a percussion piston that is driven by the drive piston, a hollow space accommodating an air spring and being formed between the drive piston and the percussion piston;

a no-load channel connecting the hollow space with the surrounding environment of the air spring hammer mechanism and ventilating the hollow space during no-load operation;

a valve, situated in the no-load channel, for opening and closing the no-load channel;

a hammer housing that surrounds at least the air hammer percussion mechanism;

a detection apparatus that detects a pressure force that is applied to the handle by the operator and that is situated in the flow of force between the grasping point and the hammer housing; and wherein the valve is controlled dependent on the detected pressure force.

2. The hammer drill and/or percussion hammer as recited in claim 1, wherein the handle moves relative to the hammer housing.

3. The hammer drill and/or percussion hammer as recited in claim 2, wherein a spring system appertaining to the acquisition apparatus is provided between the handle and the hammer housing, in order to hold the handle relative to the hammer housing with a predetermined spring force.

4. The hammer drill and/or percussion hammer as recited in claim 3, wherein the detection apparatus has an extension that is coupled with the handle and that moves with the handle, relative to the hammer housing, against the action of the spring system, in such a way that its displacement is essentially proportional to the pressure force applied by the operator.

5. The hammer drill and/or percussion hammer as recited in claim 3, wherein the spring system is also a component of an apparatus for dampening the vibrations of the handle.

6. The hammer drill and/or percussion hammer as recited in claim 1, wherein a sleeve that forms a control element of the valve and that moves axially is provided, whose axial position is dependent on the pressure force.

7. The hammer drill and/or percussion hammer as recited in claim 6, wherein the sleeve is connected with the handle in a positively locking fashion in the axial direction.

8. The hammer drill and/or percussion hammer as recited in claim 1, wherein the drive piston has a hollow construction;

the percussion piston moves axially in the drive piston, and wherein in a cylindrical wall of the drive piston, a plurality of openings are provided that are situated alongside one another with reference to an axial direction of the drive piston, and which respectively form a part of the no-load channel, according to the axial position of the drive piston.

9. The hammer drill and/or percussion hammer as recited in claim 8, wherein the drive piston is radially surrounded by the sleeve;

in the sleeve, a radial opening that forms a part of the no-load channel is provided that, in each operating state of the air spring hammer mechanism, is situated over at least one of the openings in the wall of the drive piston;

the sleeve is accommodated in a percussion mechanism housing;

in the percussion mechanism housing, a recess is provided that likewise forms a part of the no-load channel and that communicates with the surrounding environment, and wherein for the no-load operation of the air spring percussion mechanism, the radial opening moves over the recess in the percussion mechanism housing dependent on the pressure force, in such a way that the hollow space in the drive piston stands in communicating connection with the surrounding environment via the openings in the side wall of the drive piston, the radial opening in the sleeve, and the recess in the percussion mechanism housing.

10. The hammer drill and/or percussion hammer as recited in claim 1, wherein the detection apparatus has a sensor that detects a state in which the handle is pressed against the hammer housing against the action of a spring system, and that produces a pressure signal;

the valve has a valve element that is controlled mechanically, electrically, electromechanically, or electromagnetically, and wherein the pressure signal is supplied to a control unit that controls the valve element to open and close the valve.

11. The hammer drill and/or percussion hammer as recited in claim 10, wherein the sensor is a proximity sensor or a force measurement sensor.

12. The hammer drill and/or percussion hammer as recited in claim 10, wherein the detection apparatus includes a position sensor that detects the position of the hammer drill and/or percussion hammer in space relative to a horizontal plane, and that produces a corresponding position signal; wherein the position signal is supplied to the control unit, and wherein the control unit controls the valve element using an evaluation of the pressure signal and the position signal.

13. The hammer drill and/or percussion hammer as recited in claim 11, wherein, in the evaluation of the pressure signal and of the position signal, a deviation of the position of the hammer drill and/or percussion hammer from the horizontal plane is taken into account in such a way that the resulting pressure signal is subjected to a correction, taking into account the effective weight forces of the handle, of the hammer housing and the components contained therein, as well as of a tool.

14. A hammer drill and/or percussion hammer, comprising:

at least one handle having a grasping point;

an air spring hammer mechanism having a drive piston that moves back and forth and a percussion piston that is driven by the drive piston, a hollow space accommodating an air spring and being formed between the drive piston and the percussion piston, a no-load channel connecting the hollow space with the surrounding environment of the air spring hammer mechanism and ventilating the hollow space during no-load operation;

a valve that is situated in the no-load channel and that selectively opens and closes the no-load channel;

a hammer housing that surrounds at least the air hammer percussion mechanism;

a detection apparatus that detects a pressure force that is applied to the handle by the operator and that is situated in a path of the flow of force between the grasping point and the hammer housing; and wherein the valve is responsive to the detection apparatus so as to be controlled in dependence on the detected pressure force.

15. The hammer drill and/or percussion hammer as recited in claim 14, wherein the handle is movable relative to the hammer housing.

16. The hammer drill and/or percussion hammer as recited in claim 14, further comprising an axially movable sleeve a position of which is dependent on the pressure source, wherein the sleeve forms a control element of the valve.

17. The hammer drill and/or percussion hammer as recited in claim 14, wherein the drive piston is hollow and has a cylindrical wall;

the percussion piston moves axially in the drive piston, and a plurality of openings are formed in the cylindrical wall of the drive piston and are situated alongside one another with reference to an axial direction of the drive piston, wherein specific one or specific ones of the openings form a part of the no-load channel dependent on the axial position of the drive piston.

18. The hammer drill and/or percussion hammer as recited in claim 17, further comprising a percussion mechanism housing; wherein the sleeve is accommodated in the percussion mechanism housing and radially surrounds the drive piston;

a radial opening is formed in the sleeve and forms a part of the no-load channel;

in each operating state of the air spring hammer mechanism, the radial opening in the sleeve is situated over at least one of the openings in the wall of the drive piston;

a recess is formed in the percussion mechanism housing, forms part of the no-load channel, and communicates with the surrounding environment, and wherein for the no-load operation of the air spring percussion mechanism, the radial opening moves over the recess in the percussion mechanism housing dependent on the pressure force, in such a way that the hollow space in the drive piston communicates with the surrounding environment via the openings in the side wall of the drive piston, the radial opening in the sleeve, and the recess in the percussion mechanism housing.

19. The hammer drill and/or percussion hammer as recited in claim 14, wherein the detection apparatus has a sensor that detects a state in which the handle is pressed against the hammer housing against the action of a spring system and that produces a pressure signal;

the valve has a valve element that is controlled mechanically, electrically, electromechanically, or electromagnetically, and wherein the pressure signal is supplied to a control unit that controls the valve element to open and close the valve.

* * * * *

UNITED STATES PATENT AND TRADEMARK OFFICE

CERTIFICATE OF CORRECTION

PATENT NO. : 6,913,088 B2
DATED : July 5, 2005
INVENTOR(S) : Berger et al.

It is certified that error appears in the above-identified patent and that said Letters Patent is hereby corrected as shown below:

Title page,
Item [75], Inventors, should read:
-- Rudolf Berger, Grünwald (DE)
Wolfgang Schmid, München (DE) --.

Signed and Sealed this

Twenty-first Day of March, 2006

JON W. DUDAS
*Director of the United States Patent and Trademark Office*